US006932573B2

(12) United States Patent
Liang

(10) Patent No.: US 6,932,573 B2
(45) Date of Patent: Aug. 23, 2005

(54) TURBINE BLADE HAVING A VORTEX FORMING COOLING SYSTEM FOR A TRAILING EDGE

(75) Inventor: George Liang, Palm City, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 35 days.

(21) Appl. No.: 10/426,729

(22) Filed: Apr. 30, 2003

(65) Prior Publication Data

US 2004/0219017 A1 Nov. 4, 2004

(51) Int. Cl.[7] ..... F01D 5/18
(52) U.S. Cl. ..... 416/97 R; 415/115
(58) Field of Search ..... 415/115; 416/97 R

(56) References Cited

U.S. PATENT DOCUMENTS

| | | | | |
|---|---|---|---|---|
| 4,293,275 | A | | 10/1981 | Kobayashi et al. |
| 4,407,632 | A | | 10/1983 | Liang |
| 4,505,639 | A | * | 3/1985 | Groess et al. ..... 416/97 R |
| 4,514,144 | A | | 4/1985 | Lee |
| 4,515,523 | A | | 5/1985 | North et al. |
| 4,601,638 | A | | 7/1986 | Hill et al. |
| 4,752,186 | A | | 6/1988 | Liang |
| 5,263,820 | A | * | 11/1993 | Tubbs ..... 416/97 R |
| 5,603,606 | A | * | 2/1997 | Glezer et al. ..... 416/97 R |
| 5,690,472 | A | | 11/1997 | Lee |
| 5,695,320 | A | | 12/1997 | Kercher |
| 5,993,156 | A | | 11/1999 | Bailly et al. |
| 6,004,100 | A | | 12/1999 | Przirembel et al. |
| 6,033,181 | A | * | 3/2000 | Endres et al. ..... 416/97 R |
| 6,056,505 | A | | 5/2000 | Cunha et al. |
| 6,139,269 | A | | 10/2000 | Liang |
| 6,179,565 | B1 | | 1/2001 | Palumbo et al. |
| 6,227,804 | B1 | | 5/2001 | Koga et al. |
| 6,305,903 | B1 | | 10/2001 | Semmler et al. |
| 6,328,531 | B1 | | 12/2001 | Bariaud et al. |
| 6,402,470 | B1 | | 6/2002 | Kvasnak et al. |
| 6,422,819 | B1 | | 7/2002 | Tsai et al. |
| 6,481,966 | B2 | | 11/2002 | Beeck et al. |
| 2002/0106275 | A1 | | 8/2002 | Harvey |

FOREIGN PATENT DOCUMENTS

| | | |
|---|---|---|
| EP | 1111190 A1 | 6/2001 |
| JP | 2002 129903 A | 5/2002 |
| WO | 01/31170 A1 | 2/2001 |

* cited by examiner

*Primary Examiner*—F. Daniel Lopez
*Assistant Examiner*—Richard A Edgar

(57) ABSTRACT

A turbine blade for a turbine engine having one or more cavities in a trailing edge of the turbine blade for forming one or more vortices in inner aspects of the trailing edge. In at least one embodiment, the turbine blade may include one or more elongated cavities in the trailing edge of the blade formed by one or more ribs placed in a cooling chamber of the turbine blade. The elongated cavity in the trailing edge may have one or more orifices in the rib on the upstream side of the cavity. The orifice may be positioned relative to a vortex forming surface so that as a gas is passed through one or more orifices into the elongated cavity, one or more vortices are formed in the cavity. The gas may be expelled from the cavity and the blade through one or more orifices in an inner wall forming the pressure side of the turbine blade.

20 Claims, 4 Drawing Sheets

TURBINE BLADE HAVING A VORTEX FORMING COOLING SYSTEM FOR A TRAILING EDGE

FIELD OF THE INVENTION

This invention is directed generally to turbine blades, and more particularly to hollow turbine blades having an intricate maze of cooling channels for passing fluids, such as air, to cool the blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Operation of a turbine engine results is high stresses being generated in numerous areas of a turbine blade. One particular area of high stress is found in the blade's trailing edge, which is a portion of the blade forming a relatively thin edge that is generally orthogonal to the flow of gases past the blade and is on the downstream side of the blade. Because the trailing edge is relatively thin and an area prone to development of high stresses during operation, the trailing edge is highly susceptible to formation of cracks. These cracks may propagate and cause failure of the blade, which may, in some situations, cause catastrophic damage to a turbine engine.

A conventional cooling system in a turbine blade assembly discharges a portion, if not a substantial portion, of the cooling air through a trailing edge of the blade. Typically, the cooling air is discharged through a plurality of openings on the pressure side of the blade. In addition, a cooling system often contains an intricate maze of cooling flow paths in a trailing edge. There exist numerous configurations of the cooling flow paths that attempt to maximize the convection occurring in a trailing edge of a blade. However, uneven heating in trailing edge portions of a turbine blade still often exists.

Thus, a need exists for a turbine blade that effectively dissipates heat in a trailing edge portion of a turbine blade and maintains aspects of the trailing edge portion at the same general temperature.

SUMMARY OF THE INVENTION

This invention relates to a turbine blade capable of being used in turbine engines and having a cooling system located at least in inner aspects of a trailing edge of the turbine blade. The turbine blade may be formed from a generally elongated blade and a root coupled to the blade. The blade may have an outside surface configured to be operable in a turbine engine and may include a leading edge, a trailing edge, a tip at a first end, and one or more cavities forming a cooling system. The root may be coupled to the blade at an end generally opposite the first end for supporting the blade and for coupling the blade to a disc.

The cavity may include one or more ribs positioned in the cavity forming the cooling system to deform a generally elongated cavity in the trailing edge portion of the blade by dividing the cavity forming the cooling system into a trailing edge cavity and a body cavity. The rib may include one or more orifices for allowing cooling gases to pass through the rib. Each orifice may be formed from an opening in an upstream surface of the rib that extends through the rib to an opening in a downstream surface of the rib facing the trailing edge cavity. The opening in the downstream surface of the rib may be positioned adjacent to a vortex forming surface. In at least one embodiment, the opening in the downstream surface of the rib may contact the vortex forming surface. The vortex forming surface may be any surface capable of forming a vortex. In at least one embodiment, the vortex forming surface may be the bottom surface forming the trailing edge cavity. In another embodiment, the vortex forming surface may be the top surface forming the trailing edge cavity.

In at least one embodiment, the turbine blade may have two ribs in the cooling cavity forming first and second trailing edge cavities, separated from the body by one of two ribs. In yet another embodiment, the turbine blade may include a third rib in the cooling cavity to form a third trailing edge cavity. The turbine blade may also include one or more orifices through an outer wall of the trailing edge of the blade for expelling gases from the trailing edge cavities. The orifices may include an opening in the elongated cavity in the trailing edge and an opening facing the trailing edge cavities and extend to an opening in an outside surface of the blade.

During operation, a gas, such as air, enters a cooling cavity in a blade through openings in the blades root. The gas travels through the cooling cavity toward the trailing edge of the blade. In one embodiment having first and second trailing edge cavities, the gas passes through one or more orifices in the second rib and into a second trailing edge cavity. As the gas flows into the second trailing edge cavity, the gas passes along a vortex forming surface. The gas then changes direction as it contacts an upstream surface of the first rib. The gas continues to flow around the outer surfaces forming the second trailing edge cavity and thus may form one or more vortices. The gas may then pass through one or more orifices in the first rib and into the first trailing edge cavity. The gas may also form one or more vortices in the first trailing edge cavity. The gas may then be expelled from the blade by passing through the one or more orifices in the outer wall. In particular, the gas may be expelled from the blade through one or more orifices in the trailing edge of the inner wall that forming a portion of the outer wall on the pressure side of the blade. These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
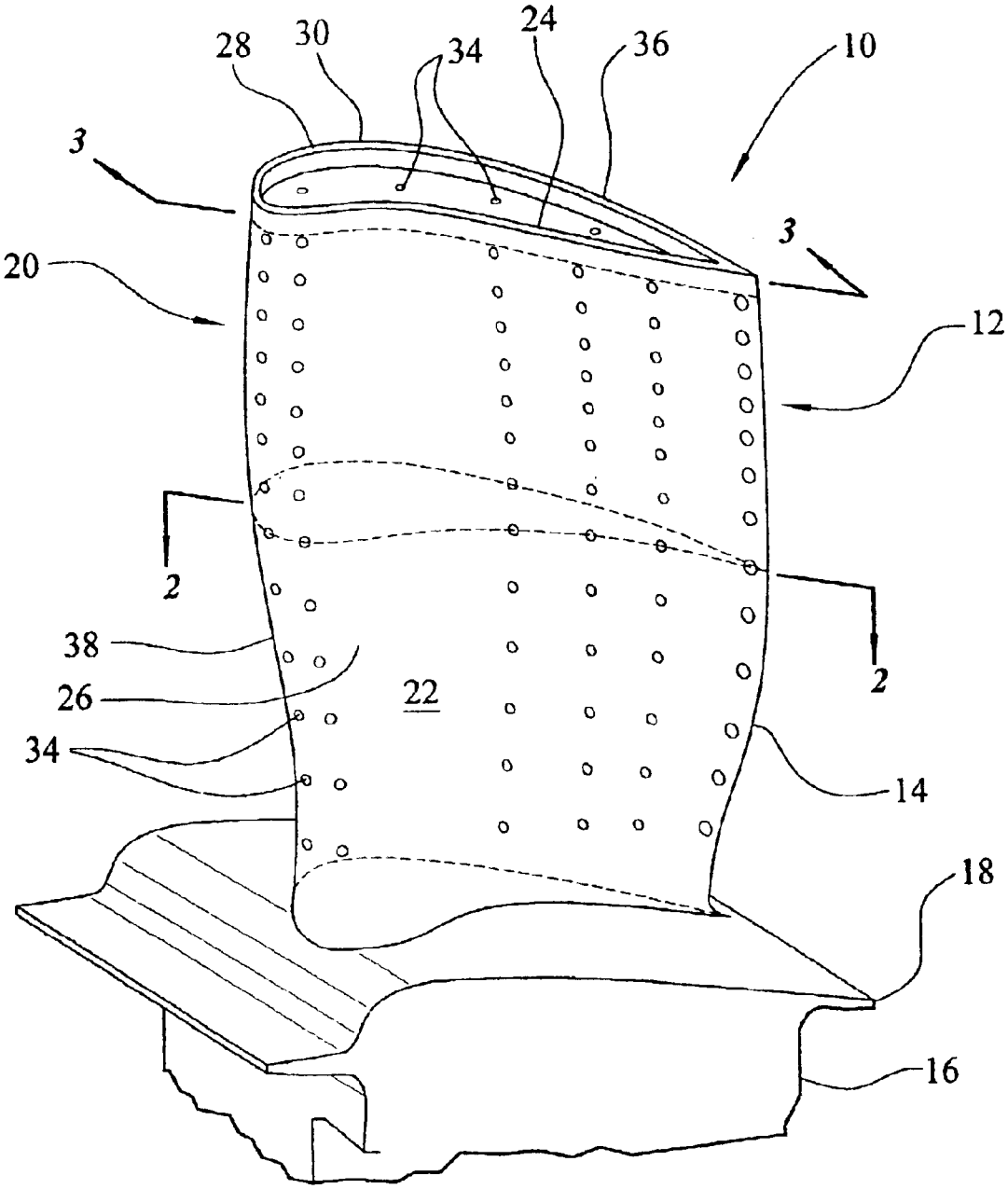
FIG. 1 is a perspective view of a turbine blade having features according to the instant invention.

As shown in FIGS. 1–5, this invention is directed to a turbine blade cooling system 10 for turbine blades 12 used in turbine engines. In particular, turbine blade cooling system 10 is directed to a cooling system located in inner aspects of a trailing edge 14 of turbine blade 12. As shown in FIG. 1, the turbine blade 12 may be formed from a root 16 having a platform 18 and a generally elongated blade 20 coupled to the root 16 at the platform 18. Blade 20 may have an outer surface 22 adapted for use, for example, in a first stage of an axial flow turbine engine. Outer surface 22 may be formed from an inner wall 24 that may have a generally concave shape and form pressure side 26. Pressure side 26 may be positioned generally opposite to an outer wall 28 that may have a generally convex shape and form suction side 30. Blade 20 may include one or more cavities 32 positioned between inner wall 24 and outer wall 28. Cavity 32 may include one or more cooling paths 56 for directing one or more gases, which may include air received from a compressor (not shown), through blade 20 and out of one or more orifices 34 in blade 20. Orifices 34 may be positioned in tip 36, leading edge 38, or trailing edge 14, or any combination thereof, and have various configurations.

Figure 3:
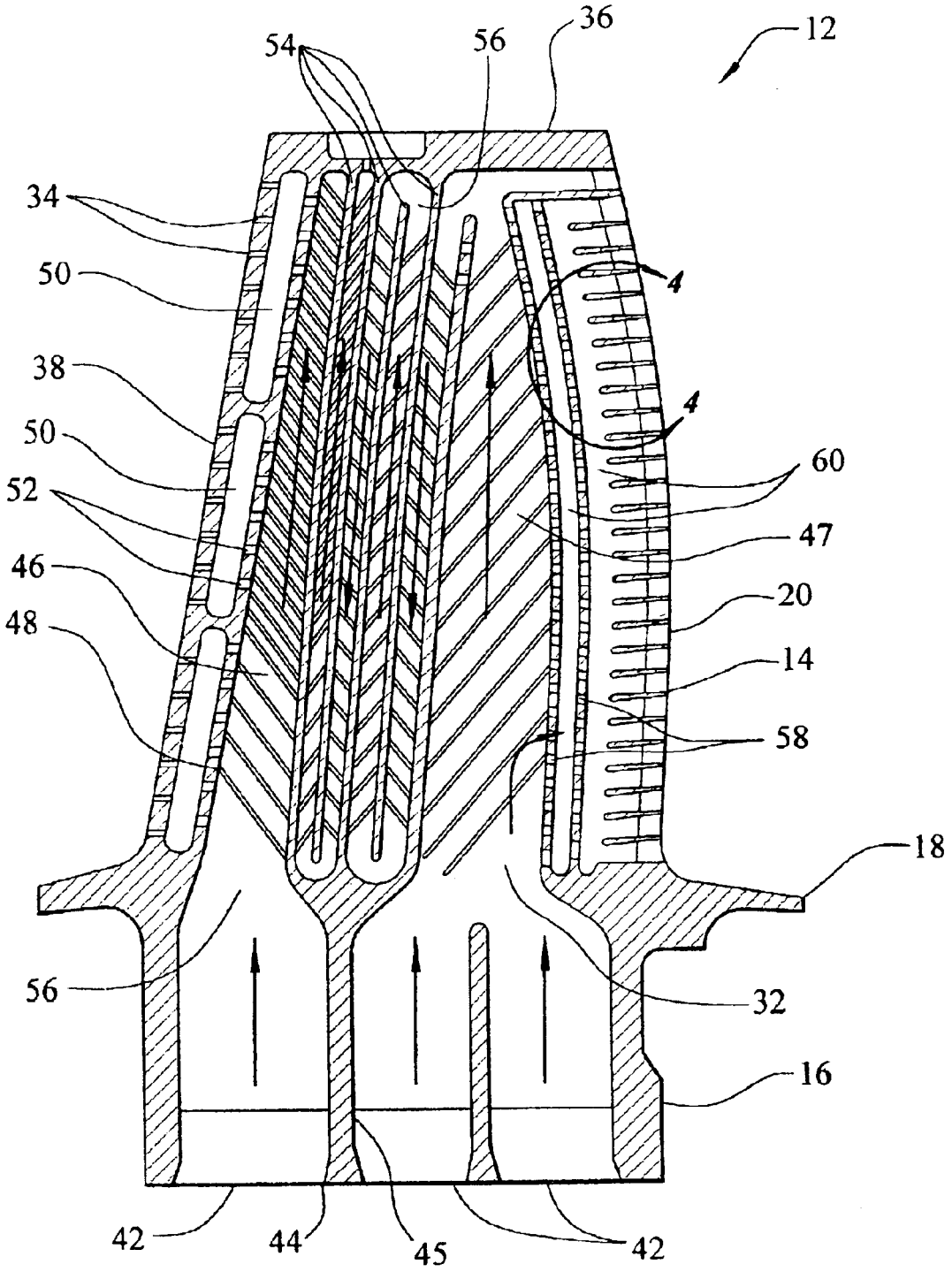
FIG. 3 is a cross-sectional view of the turbine blade shown in FIG. 1 taken along line 3—3.

Cavity 32 may be arranged in various configurations. For instance, as shown in FIG. 3, cavity 32 may form cooling chambers that extend through root 16 and blade 20. In particular, cavity 32 may extend from tip 36 to one or more orifices 42 in an end 44 of root 16 that is opposite to tip 36. Alternatively, cavity 32 may be formed only in portions of root 16 and blade 20. Orifices 42 may be configured to receive a cooling fluid, such as air, from the compressor (not shown). Cavity 32 may optionally include a rib 45 dividing the cavity into a first elongated cooling chamber 46 positioned proximate to leading edge 38 and a second elongated cooling chamber 47 positioned proximate to trailing edge 14.

First elongated cooling chamber 46 may include any number of cooling paths. For instance and not by way of limitation, first elongated cooling chamber 46 may include a leading edge rib 48 forming one or more leading edge cooling chambers 50 proximate to leading edge 38. Leading edge rib 48 may include one or more orifices 52, and in at least one embodiment, the leading edge rib 48 may include a plurality of orifices 52 that may or may not be equally spaced along the leading edge rib 48 relative to each other. First elongated cooling chamber 46 may also include one or more orifices 34 positioned in leading edge 38 which may be arranged to form a conventional shower head to expel gases from the first cooling chamber 46. First elongated cooling chamber 46 may also include one or more orifices 34 in tip 36 for expelling gases.

Second elongated cooling chamber 47, which may also be referred to as a body cavity, may include any number of cooling paths. For example and not by way of limitation, second elongated cooling chamber 47 may include one or more ribs 54 forming a serpentine shaped cooling path 56. Cooling path 56 may include one or more orifices 34 in tip 36 to expel cooling gases. The configurations described above for first and second elongated cooling paths 46 and 47 may be configured as described above and shown in FIG. 3, or may have other configurations appropriate to dissipate heat from blade 20 during use.

Figure 5:
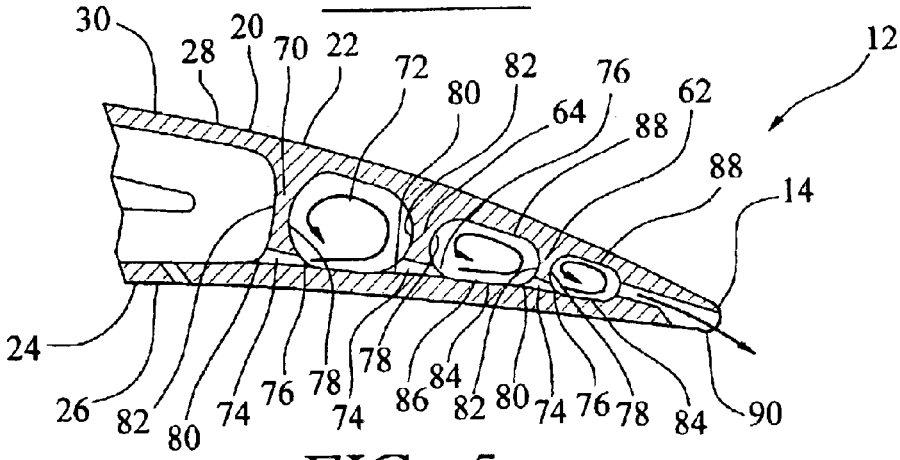
FIG. 5 is a cross-sectional view of an alternative embodiment of the instant invention having three trailing edge cavities.

Cavity 32 may include one or more ribs 58 dividing cavity 32 and forming one or more elongated trailing edge cavities 60 and a body cavity 32. In one embodiment, trailing edge cavity 60 may extend from tip 36 to platform 18. Alternatively, trailing edge cavity 60 may extend only a portion of the distance between tip 36 and platform 18. In one embodiment, cavity 32 may include two ribs 58, first rib 62 and second rib 64, forming a first trailing edge cavity 66 and a second trailing edge cavity 68. In yet another embodiment, cavity 32 may include a third rib 70, as shown in FIG. 5, forming a third trailing edge cavity 72.

Figure 2:
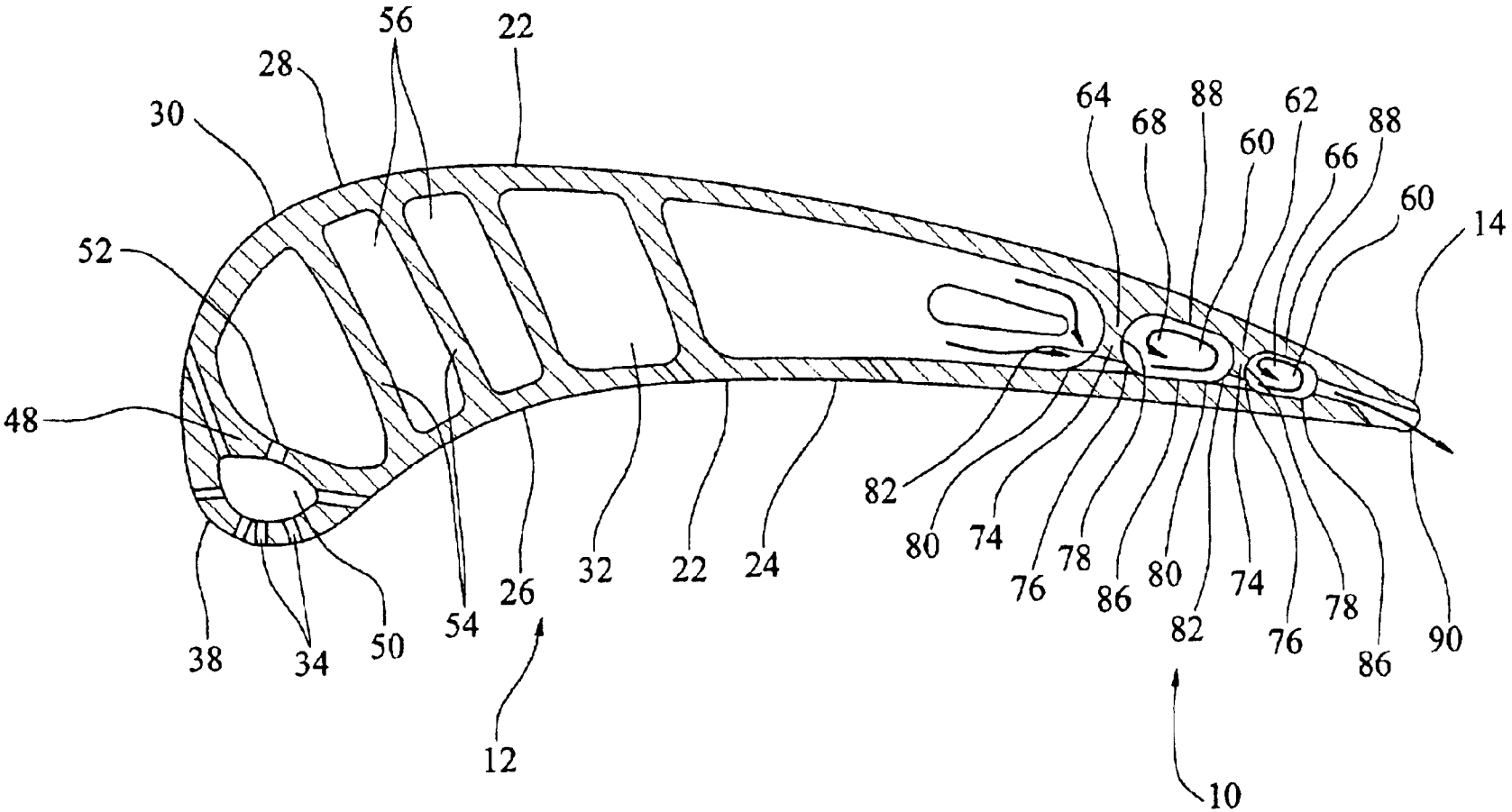
FIG. 2 is cross-sectional view of the turbine blade shown in FIG. 1 taken along line 2—2.

Ribs 58 may include one or more orifices 74. In at least one embodiment, first rib 62 may include a plurality of orifices 74. Orifices 74 may he positioned equidistant from each other along first rib 62. In at least one embodiment, orifices 74 may be generally orthogonal to ribs 58. First rib 62 may include one or more orifices 74. Each orifice 74 may include an opening 76 in a downstream surface 78 of first rib 62 forming first trailing edge cavity 66 and an opening 80 in an upstream surface 82 of first rib 62, wherein upstream surface 82 is generally opposite to surface 78. As shown in FIGS. 2 and 5, opening 76 may be smaller than opening 80 of orifice 74. Alternatively, opening 76 may be equal in size to opening 80 of orifice 74. Opening 76 of orifice 74 may be positioned adjacent to a vortex forming surface 84 so that as a gas is passed through orifice 74, the gas may travel and change directions upon reaching upstream surface 82 of a rib and cause the formation of a vortex. In one embodiment, opening 76 of orifice 74 may contact vortex forming surface 84.

Vortex forming surface 84 may include a bottom surface 86 forming first trailing edge cavity 66. Thus, orifice 74 may be positioned adjacent to bottom surface 86. Bottom surface 86 may also be referred to as the pressure side of first trailing edge cavity 66 and the other trialing edge cavities described below. In other embodiments, vortex forming surface 84 may include a top surface 88 forming first trailing edge cavity 66. Thus, orifice 74 may be positioned adjacent to top surface 88. Top surface 88 may also be referred to as the suction side of first trailing edge cavity 66 and the other trialing edge cavities described below. In yet other embodiments, vortex forming surface 84 is not limited to these configurations. Rather, vortex forming surface may be other surfaces positioned in trailing edge cavities 60.

Second rib 64 and third rib 70 may include orifices 74 as previously explained for first rib 62 but are not further described here for brevity. Further, the preceding explanation of the position of orifices 74 relative to each other, to vortex forming surface 84, to bottom surface 86, and to top surface 88 is applicable to second rib 64 and third rib 70 as well. In addition, the remaining elements and alternative embodiments as previously discussed for first rib 62 are applicable to second rib 64 and third rib 70.

Figure 4:
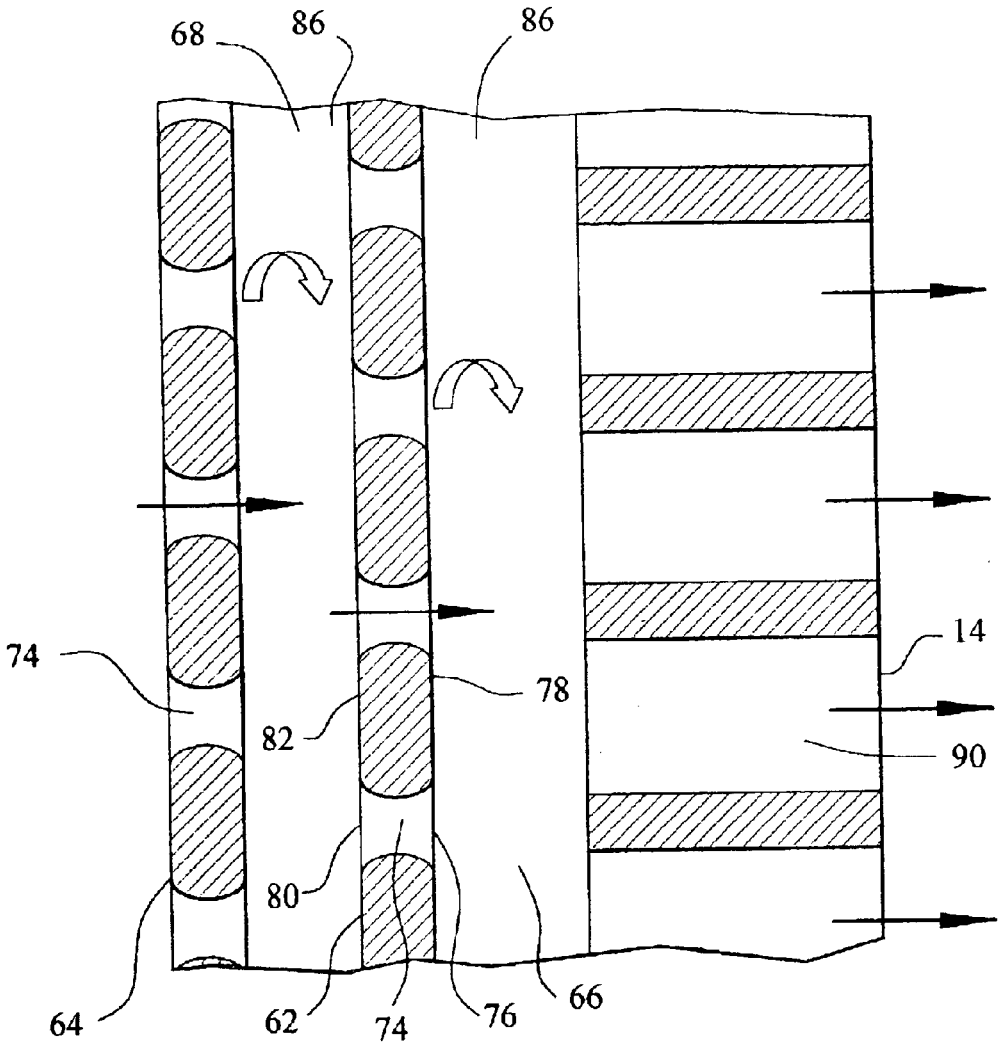
FIG. 4 is a detail view of a trail edge of the turbine blade shown in FIG. 3 taken at detail 4.

In embodiments having two or more ribs 58 with orifices 74, the orifices in a rib adjacent to a first rib may be offset radially from orifices in the first rib. For example, as shown in FIG. 4, orifices 74 located in second rib 64 may be offset radially along the second rib relative to the orifices in first rib 62. In addition, orifices 74 in third rib 70 may be offset radially along the third rib relative to orifices in second rib 64.

Trailing edge 14 may also include one or more trailing edge orifices 90 in inner wall 24. In at least one embodiment, trailing edge orifice 90 may be one continuous elongated slot extending from platform 18 to tip 36. Alternatively, as shown in FIGS. 2, 4, and 5, trailing edge 14 may include a plurality of trailing edge orifices 90 in inner wall 24 enabling gases to be expelled from first trailing edge cavity 66. In at least one embodiment as shown in FIG. 4, trailing edge orifices 90 may be offset radially from orifices 74 in first rib 62.

During operation, one or more gases are passed into cavity 32 through orifices 42 in root 16. The gases may or may not be received from a compressor (not shown). In one embodiment, as shown in FIG. 2, the gas flows outward toward tip 36 and passes through orifices 74 in second rib. As the gas enters second trailing edge cavity 68, the gas may form a vortex in the second trailing edge cavity 68. The vortex may be formed by the gas traveling generally parallel to bottom surface 86 and changing directions to flow along upstream surface 82 of first rib 62. In other embodiments, a vortex may be formed by the gas traveling generally parallel to top surface 88 and changing directions to flow along upstream surface of first rib 62. The vortex formed in second trailing edge cavity 68 may increase the rate of heat transfer from bottom surface 86, top surface 88, first rib 62 and second rib 64 forming the second trailing edge cavity relative to a rate of heat transfer resulting from one or more turbulent or mixed gases passing through inner aspects of trailing edge 14.

Vortex formation is encouraged because trailing edge orifice 90 is positioned in an area of blade 20 having a relatively low pressure. More importantly, a gas pressure in cavity 32 is greater than the gas pressure outside of blade 20 at trailing edge orifice 90 during operation. Thus, a gas in cavity 32 flows through orifices 74 in second rib 64, forms a vortex in second trailing edge cavity 68, passes through orifices 74 in first rib 62, forms a vortex in first trailing edge cavity 66, and passes through trailing edge orifices 90. As the gas is expelled from second trailing edge cavity 68 to first trailing edge cavity 66, the gas travels generally orthogonal to an axis of rotation of a vortex formed in the second trailing edge cavity and thus does not dissipate the vortex formed in the second trailing edge cavity.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, and a tip at a first end, a root coupled to the blade at an end generally opposite the first end for supporting the blade and for coupling the blade to a disc, and at least one cavity forming a cooling system in the blade;

at least one rib positioned in the at least one cavity to form a generally elongated cavity along at least a portion of the trailing edge of the blade by dividing the at least one cavity into a trailing edge cavity and a body cavity;

wherein the at least one rib includes at least one orifice formed from at least one opening in an upstream surface of the at least one rib that extends through the at least one rib to at least one opening in a downstream surface of the at least one rib;

wherein the at least one opening in the downstream surface of the at least one rib is positioned adjacent to a vortex forming surface; and wherein the trailing edge includes at least one orifice in an outer wall of the blade extending from the trailing edge cavity.

2. The turbine blade of claim 1, wherein the vortex forming surface comprises at least a bottom surface forming the trailing edge cavity.

3. The turbine blade of claim 1, wherein the vortex forming surface comprises at least a top surface forming the trailing edge cavity.

4. The turbine blade of claim 1, wherein the vortex forming surface comprises at least a surface in contact with an edge forming the at least one opening in the downstream surface of the at least one rib.

5. The turbine blade of claim 1, wherein the vortex forming surface is generally orthogonal to the downstream surface of the at least one rib.

6. The turbine blade of claim 1, wherein the opening of the at least one orifice in the downstream surface of the at least one rib is smaller than the opening of the at least one orifice in the upstream surface of the at least one rib.

7. The turbine blade of claim 1, wherein the at least one orifice in the at least one rib comprises a plurality of orifices.

8. The turbine blade of claim 1, further comprising a second rib positioned in the body cavity forming a second generally elongated trailing edge cavity, wherein the second rib comprises at least one orifice.

9. The turbine blade of claim 8, further comprising a third rib positioned in the body cavity forming a third generally elongated trailing edge cavity, wherein the third rib comprises at least one orifice.

10. The turbine blade of claim 8, wherein the at least one orifice in the at least one rib comprises a plurality of orifices in a first rib and the at least one orifice in the second rib comprises a plurality of orifices, wherein the plurality of orifices in the second rib are offset radially from the plurality of orifices in the first rib.

11. A turbine blade, comprising:

a generally elongated blade having a leading edge, a trailing edge, and a tip at a first end, a root coupled to the blade at an end generally opposite the first end for supporting the blade and for coupling the blade to a disc, and at least one cavity forming a cooling system in the blade;

a first rib positioned in the at least one cavity to form a generally elongated cavity in the trailing edge of the blade by dividing the at least one cavity into a first trailing edge cavity and a body cavity;

wherein the first rib includes at least one orifice formed from at least one opening in an upstream surface of the first rib that extends through the first rib to at least one opening in a downstream surface of the first rib;

wherein the at least one opening in the downstream surface of the first rib is positioned adjacent to a first vortex forming surface;

a second rib positioned in the body cavity to form a generally elongated cavity in the trailing edge of the blade by dividing the body cavity into a second trailing edge cavity;

wherein the second rib includes at least one orifice formed from at least one opening in an upstream surface of the second rib that extends through the second rib to at least one opening in a downstream surface of the second rib;

wherein the at least one opening in the downstream surface of the second rib is positioned adjacent to a second vortex forming surface; and wherein the trailing edge includes at least one orifice in an outer wall of the blade extending from the trailing edge cavity.

12. The turbine blade of claim 11, wherein the first and second vortex forming surfaces are bottom surfaces forming the first and second trailing edge cavities.

13. The turbine blade of claim 11, wherein the first and second vortex forming surfaces are top surfaces forming the first and second trailing edge cavities.

14. The turbine blade of claim 11, wherein the first vortex forming surface contacts the at least one opening in the downstream surface of the first rib, and the second vortex forming surface contacts the at least one opening in the downstream surface of the second rib.

15. The turbine blade of claim 11, wherein the first vortex forming surface is generally orthogonal to the downstream surface of the first rib, and the second vortex forming surface is generally orthogonal to the downstream surface of the second rib.

16. The turbine blade of claim 11, wherein the at least one opening in the downstream surface of the first rib is smaller than the at least one opening in the upstream surface of the first rib, and the at least one opening in the downstream surface of the second rib is smaller than the at least one opening in the upstream surface of the second rib.

17. The turbine blade of claim 11, further comprising a third rib positioned in the body cavity forming a third generally elongated trailing edge cavity, wherein the third rib comprises at least one orifice.

18. A turbine blade, comprising:

a generally elongated blade having a leading edge, a trailing edge, and a tip at a first end, a root coupled to the blade at an end generally opposite the first end for supporting the blade and for coupling the blade to a disc, and at least one cavity forming a cooling system in the blade;

a first rib positioned in the at least one cavity to form a generally elongated cavity in the trailing edge of the blade by dividing the at least one cavity into a first trailing edge cavity and a body cavity;

wherein the first rib includes at least one orifice formed from at least one opening in an upstream surface of the first rib that extends through the first rib to at least one opening in a downstream surface of the first rib;

wherein the at least one opening in the downstream surface of the first rib is positioned adjacent to a first vortex forming surface;

a second rib positioned in the body cavity to form a generally elongated cavity in the trailing edge of the blade by dividing the body cavity into a second trailing edge cavity;

wherein the second rib includes at least one orifice formed from at least one opening in an upstream surface of the second rib that extends through the second rib to at least one opening in a downstream surface of the second rib;

wherein the at least one opening in the downstream surface of the second rib is positioned adjacent to a second vortex forming surface;

a third rib positioned in the body cavity to form a generally elongated cavity in the trailing edge of the blade by dividing the body cavity into a third trailing edge cavity;

wherein the third rib includes at least one orifice formed from at least one opening in an upstream surface of the third rib that extends through the third rib to at least one opening in a downstream surface of the third rib;

wherein the at least one opening in the downstream surface of the third rib is positioned adjacent to a third vortex forming surface; and wherein the trailing edge includes at least one orifice in an outer wall of the blade extending from the trailing edge cavity.

19. The turbine blade of claim 18, wherein the first vortex forming surface contacts the at least one opening in the downstream surface of the first rib, the second vortex forming surface contacts the at least one opening in the downstream surface of the second rib, and the third vortex forming surface contacts the at least one opening in the downstream surface of the third rib.

20. The turbine blade of claim 18, wherein the at least one opening in the downstream surface of the first rib is smaller than the at least one opening in the upstream surface of the first rib, the at least one opening in the downstream surface of the second rib is smaller than the at least one opening in the upstream surface of the second rib, and the at least one opening in the downstream surface of the third rib is smaller than the at least one opening in the upstream surface of the third rib.

* * * * *